US011280123B2

(12) United States Patent
Zirek

(10) Patent No.: US 11,280,123 B2
(45) Date of Patent: Mar. 22, 2022

(54) DOOR STOPPER

(71) Applicant: Ercan Zirek, Izmir (TR)

(72) Inventor: Ercan Zirek, Izmir (TR)

( * ) Notice: Subject to any disclaimer, the term of this patent is extended or adjusted under 35 U.S.C. 154(b) by 601 days.

(21) Appl. No.: 16/327,858

(22) PCT Filed: Aug. 16, 2017

(86) PCT No.: PCT/TR2017/050392
§ 371 (c)(1),
(2) Date: Feb. 25, 2019

(87) PCT Pub. No.: WO2018/067097
PCT Pub. Date: Apr. 12, 2018

(65) Prior Publication Data

US 2020/0355006 A1 Nov. 12, 2020

(30) Foreign Application Priority Data

Aug. 26, 2016 (TR) ..... 2016/12143

(51) Int. Cl.

| | |
|---|---|
| ***E05C 17/48*** | (2006.01) |
| ***E05C 17/52*** | (2006.01) |
| ***E05F 5/08*** | (2006.01) |
| ***E05F 5/06*** | (2006.01) |
| *E05F 5/02* | (2006.01) |

(52) U.S. Cl.
CPC ..... *E05C 17/48* (2013.01); *E05C 17/52* (2013.01); *E05F 5/06* (2013.01); *E05F 5/08* (2013.01); *E05F 5/02* (2013.01); *E05Y 2201/224* (2013.01); *E05Y 2900/132* (2013.01)

(58) Field of Classification Search
CPC ..... E05C 17/45; E05C 17/48; E05C 17/52; E05C 17/525; E05C 19/02; E05C 19/022; E05C 19/04; E05C 19/06; E05C 19/063; E05F 5/06; E05F 5/08; E05F 5/02; Y10T 292/088; E05B 15/1607
USPC ..... 292/DIG. 15
See application file for complete search history.

(56) References Cited

U.S. PATENT DOCUMENTS

| | | | | | |
|---|---|---|---|---|---|
| 207,120 | A | * | 8/1878 | Hunt | E05C 19/04 292/75 |
| 381,792 | A | * | 4/1888 | Jones | E05C 19/02 292/78 |
| 1,102,207 | A | * | 6/1914 | Belknap | E05C 19/04 292/73 |
| 1,577,129 | A | * | 3/1926 | Knutson | E05C 17/52 292/76 |

(Continued)

FOREIGN PATENT DOCUMENTS

| | | |
|---|---|---|
| CH | 619022 A5 | 8/1980 |
| CN | 203808677 U | 9/2014 |

(Continued)

*Primary Examiner* — Jeffrey O'Brien
(74) *Attorney, Agent, or Firm* — Bayramoglu Law Offices LLC

(57) ABSTRACT

The door stopper is adhered to the front wing of the door that has been completely opened and the door is prevented to move from this point on. When the door is desired to be closed, the door is pulled gently by hand, the force applied by the door to the stopper tensions the pressure spring and the pressure spring forces the moveable head down to the floor, thereby enabling the door to pass over the stopper.

7 Claims, 2 Drawing Sheets

(56) References Cited

U.S. PATENT DOCUMENTS 2,048,274 A * 7/1936 Luby ..... E05C 17/52 292/70
2,206,744 A * 7/1940 Loecher ..... E05C 17/52 296/146.1
2,500,416 A * 3/1950 Kaminski ..... E05C 17/48 292/288
2,784,443 A * 3/1957 Von Berg ..... E05C 17/52 16/85
3,163,452 A * 12/1964 Bryson ..... E05C 17/52 292/75
3,219,374 A * 11/1965 Snell ..... E05C 17/52 292/15
3,415,561 A * 12/1968 Bryson ..... E05C 17/52 292/341.19
4,462,623 A * 7/1984 Grant ..... E05C 17/48 16/82
4,601,502 A * 7/1986 Van Dyke ..... E05C 17/48 16/82
5,018,241 A * 5/1991 Baines ..... E05C 17/48 16/82
5,331,719 A * 7/1994 Hum ..... E05C 17/54 16/85
5,653,487 A * 8/1997 Proni ..... E05C 17/54 292/164
6,161,252 A * 12/2000 Rodriguez ..... E05C 17/52 16/82
6,336,245 B1 * 1/2002 Sakakibara ..... E05C 17/48 16/82
6,572,160 B2 * 6/2003 Bunting ..... E05C 17/48 16/82
8,052,233 B2 * 11/2011 Netzer ..... A47B 88/40 312/330.1
9,228,387 B2 * 1/2016 Header ..... E05C 19/04
10,451,131 B2 * 10/2019 Nakasone ..... B60R 7/06
2007/0266522 A1 * 11/2007 Li ..... E05F 5/06 16/82
2012/0266542 A1 * 10/2012 Szprengiel ..... E05C 19/028 49/503
2014/0361553 A1 * 12/2014 Sale, Jr. ..... E05C 19/04 292/164
2021/0148160 A1 * 5/2021 Schon ..... E06B 3/88

FOREIGN PATENT DOCUMENTS

CN 203879163 U 10/2014
CN 204311886 U 5/2015
DE 19836340 C1 1/2000
EP 0705952 A1 4/1996
JP 2008280773 A 11/2008

* cited by examiner

DOOR STOPPER

CROSS REFERENCE TO RELATED APPLICATIONS

This application is the national phase entry of International Application No. PCT/TR2017/050392, filed on Aug. 16, 2017, which claims priority from the Turkish patent application No. 2016/12143 filed on Aug. 26, 2016, the entire contents of which are incorporated herein by reference.

TECHNICAL FIELD

The invention is related to a door stopper.

BACKGROUND

The known door stoppers are placed between the open door and the floor, thereby preventing the door from being closed, and the door can only be closed again then said stopper is removed. Users of such stoppers need to bend down and remove the stoppers that have been pushed under the door, themselves manually or they need to push away the stopper with their foot. Such stoppers like wedges, plastic or weights are squeezed under the door and they may damage the door or the floor; and furthermore, such stoppers are not user friendly and they lead to loss of time. As stoppers that necessitate installation require screws or nails, installation is difficult and they may damage the floor or the walls.

SUMMARY

This stopper subject to the invention is placed at the front part of the open wing of the door and it enables the door to remain open and for the door to be closed on its own. The completely opened door that has been prevented from being closed by means of the stopper can be shifted when the person using the door pulls the door with a light hand motion as the door shall press the movable head (1) of the stopper down and the door will pass over the stopper. Besides this, the stopper shall not allow the door to be closed on its own and it shall ensure that the door remains open.

By means of the stopper subject to the invention it has been intended for the door to be completely opened, to remain open or to be closed by the user without touching the stopper in any way. As it is not necessary to lean down, get up, or to push the stopper out of the way with ones foot, this makes it easier for this stopper to be used by especially people who are old, sick or disabled and it does not lead to loss of time. It is easier to assemble in comparison to stoppers that require installation; it is cleaner, cheaper, and more efficient. The stopper subject to the invention is adhered in front of the door once and no other procedure is required. It shall also protect the door and the floor.

The stopper provided in order to reach the aims of the invention has been illustrated in the attached figures.

DETAILED DESCRIPTION

Figure 1:
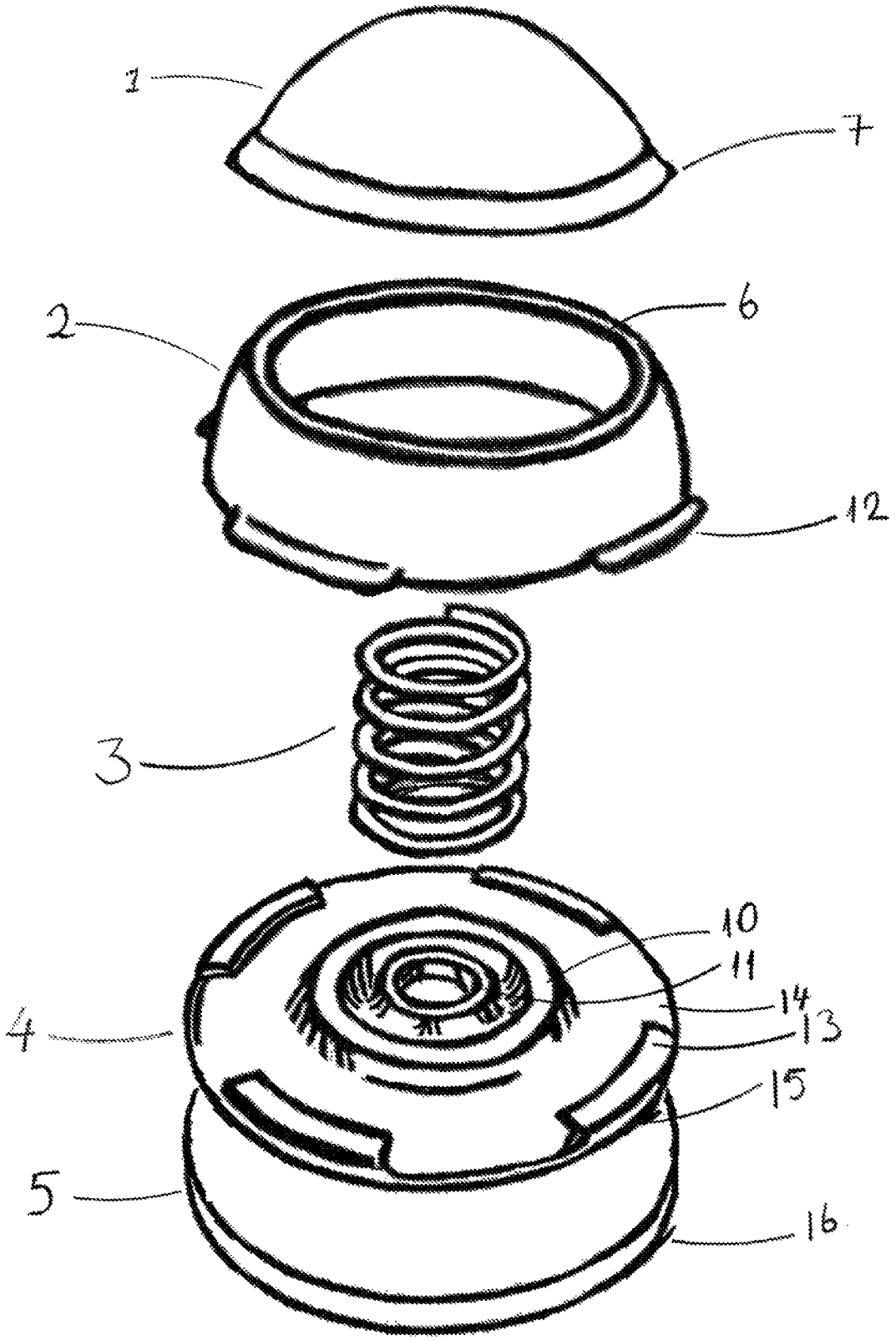
FIG. 1—is the perspective view of the deployed position of the stopper.
Figure 2:
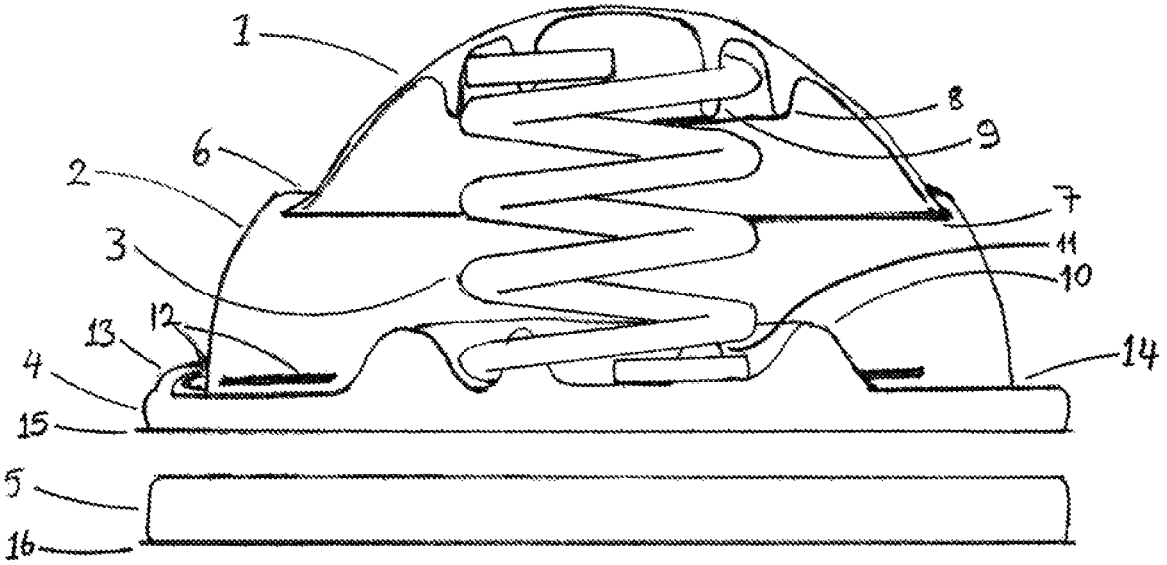
FIG. 2—is the side section view of the stopper.

The parts and the features of said parts in the figures have been numbered and the references of these numbers have been listed below.

1—Movable head 2—Fixed body 3—Thrusting spring (pressure spring) 4—Adhesive base 5—Elevation wedge 6—Narrowed top section of the fixed body 7—Fixing tab of the movable head to the fixed body 8—The outer section of the top protection groove of the pressure spring 9—The inner section of the top protection groove of the pressure spring 10—The outer section of the bottom protection groove of the pressure spring 11—The inner section of the bottom protection groove of the pressure spring 12—The mounting extension of the fixed body 13—Mounting slot of the adhesive base 14—Connection slot of the adhesive base 15—First paper which covers the adhesive of the adhesive base 16—Second paper which covers the adhesive part of the elevation wedge.

It has been aimed by the door stopper of the invention for the door to be restricted from moving freely after the stopper is adhered to the floor such that it shall come in contact with the front edge of the door's wing, when the door is completely opened, and for the door to be moved or closed easily when light hand force is applied to the door by the user.

The stopper is constituted of 5 main parts, the movable head (1) is inserted into the fixed body (2), the fixing tab (7) which enables to fix the movable head to the fixed body is attached to the narrowed top section (6) of the fixed body and thereby it is prevented from going further up and being released and following this the pressure spring (3) is placed between the inner section (9) of the top protection groove of the spring that is located at the mid section of the inner part of the movable head (1) of the top section and the outer section (8) of the top protection groove. The mounting extensions (12) of the fixed body and the mounting groove (13) of the adhesive base are rotated inside the connection slot (14) of the adhesive base and are engaged such that they interlock. The first paper (15) that covers the adhesive section of the adhesive base is removed. The stopper is placed in front of the completely opened door. In the cases that the space between the door and the floor is higher, the adhesive base (4) that is to be placed in front of the door is first of all adhered to the elevation wedge (5); the second paper (16) which covers the adhesive part of the elevation wedge is removed, the elevation wedge (5) is adhered to the floor and thereby the height between the stopper and the floor is adjusted such that a balanced contact of the movable head (1) to the door is provided. When the user of the door pulls the door in order to close it, the door comes in contact with the stopper and it applied force on the moveable head (1) and the pressure spring (3). The thrusting force constricts the pressure spring (3) and the moveable head (1) is forced down and the door smoothly passer over the stopper that is no longer in the way and therefore the door can be closed. If the user wants to open the door and wants it to remain open, when the door is moved over the stopper the moveable head (1) is contacted and it is pushed down and the pressure spring (3) is actuated, and the moveable (1) head is pushed down and the door passes over the stopper and opens. The door that is released by the user, comes back in contact with the moveable head (1) and a pressure is applied by the door, however as this pressure is not high, the thrusting force of the pressure spring (3) shall hold the moveable head (1) at a fixed position which prevents the door from closing by passing over the stopper. The aim of the stopper is to prevent the door from passing over the stopper freely.

The fixed body (2) which is a part of the stopper, the adhesive base (4) and the elevation wedge (5) remains at the space between the door and the floor such that it is adhered to the floor, these parts do not come in contact with the door at any time. The moveable head onto which a force is applied by the pressure spring (3), prevents the door from moving freely; and when the door is pulled gently by hand the door applies force to the stopper and the pressure spring (3) is tensed and the moveable head (1) is pushed down, thereby allowing the door to pass over the stopper.

The invention claimed is:

1. A door stopper configured to be mounted to a floor, the door stopper comprising:

a fixed body comprising a mounting extension, a movable head attached to the fixed body and configured to move up and down relative to the fixed body, the movable head comprising a convex top surface, an adhesive base comprising a bottom adhesive surface for mounting to the floor, the adhesive base further comprising a mounting slot and a connection slot, wherein the adhesive body is attached to the fixed body by aligning the mounting extension and the mounting slot and rotating the fixed body relative to the adhesive body to capture the mounting extension in the connection slot, a pressure spring located between the adhesive base and the movable head to enable the movable head to automatically move up and down relative to the fixed body when the convex top surface is engaged by a bottom portion of a door.

2. The door stopper of claim 1, wherein the movable head comprises a fixing tab enabling the movable head to be fixed to the fixed body.

3. The door stopper of claim 2, wherein the fixed body comprises a narrowed top to which the fixing tab is attached.

4. The door stopper of claim 1, wherein the movable head comprises an inner section and an outer section of a top protection groove for the pressure spring, wherein the pressure spring is placed between the inner section and the outer section.

5. The door stopper of claim 1, further comprising a first paper for covering the bottom adhesive surface of the adhesive base prior to adhering the adhesive base to the floor.

6. The door stopper of claim 1, further comprising an elevation wedge having a top surface and a bottom wedge adhesive surface, wherein the elevation wedge is configured for placement between the adhesive base and the floor to accommodate a higher space between the door and the floor.

7. The door stopper of claim 6, further comprising a second paper for covering the bottom wedge adhesive surface of the elevation wedge prior to adhering the elevation wedge to the floor.

* * * * *